US009235169B2

(12) United States Patent
Okuno

(10) Patent No.: US 9,235,169 B2
(45) Date of Patent: Jan. 12, 2016

(54) IMAGE FORMING APPARATUS

(71) Applicant: Konica Minolta, Inc., Tokyo (JP)

(72) Inventor: Jinju Okuno, Aichi (JP)

(73) Assignee: KONICA MINOLTA, INC. (JP)

( * ) Notice: Subject to any disclaimer, the term of this patent is extended or adjusted under 35 U.S.C. 154(b) by 108 days.

(21) Appl. No.: 14/036,730

(22) Filed: Sep. 25, 2013

(65) Prior Publication Data

US 2014/0086646 A1 Mar. 27, 2014

(30) Foreign Application Priority Data

Sep. 25, 2012 (JP) ..... 2012-210989

(51) Int. Cl.
*G03G 15/20* (2006.01)

(52) U.S. Cl.
CPC .... *G03G 15/2028* (2013.01); *G03G 2215/0132* (2013.01); *G03G 2215/0135* (2013.01)

(58) Field of Classification Search
CPC ..... G03G 15/2028
See application file for complete search history.

(56) References Cited

U.S. PATENT DOCUMENTS

| | | | | |
|---|---|---|---|---|
| 7,505,723 | B2 | 3/2009 | Roof | |
| 7,568,691 | B2 * | 8/2009 | Matsumoto | 271/97 |
| 7,911,168 | B2 * | 3/2011 | Koike | 318/432 |
| 8,167,296 | B2 * | 5/2012 | Matsumoto | 271/97 |
| 2007/0228639 | A1 * | 10/2007 | Matsumoto et al. | 271/97 |
| 2008/0036134 | A1 * | 2/2008 | Matsumoto | 271/4.03 |
| 2008/0193176 | A1 | 8/2008 | Roof | |
| 2009/0250865 | A1 * | 10/2009 | Matsumoto | 271/11 |

FOREIGN PATENT DOCUMENTS

| | | | |
|---|---|---|---|
| JP | 10265067 | A | 10/1998 |
| JP | 11157678 | A | 6/1999 |
| JP | 200315483 | A | 1/2003 |
| JP | 2008109835 | A | 5/2008 |
| JP | 2008197654 | A | 8/2008 |
| JP | 201258431 | A | 3/2012 |

OTHER PUBLICATIONS

Machine translation of JP2012-058431 to Imai, Takuya. Original Publication Date Mar. 22, 2012.*
Notice of Reasons for Rejection for Japanese Patent Application No. 2012-210989, dispatched Oct. 7, 2014, with English translation.

* cited by examiner

*Primary Examiner* — David Gray
*Assistant Examiner* — Carla Therrien
(74) *Attorney, Agent, or Firm* — Cantor Colburn LLP

(57) ABSTRACT

An image forming apparatus is provided in which an application of air for separating a sheet from a fixing section can be performed in a stable manner with an appropriate air quantity and air velocity. In the image forming apparatus, a control section sets, on the basis of an individual difference of a separation fan motor, a fan motor drive condition for a sheet passing period in which the sheet passes through a nip portion N, and the control section maintains the fan motor drive condition thus set throughout the sheet passing period.

14 Claims, 9 Drawing Sheets

| | | PAPER TYPE | |
|---|---|---|---|
| | | PLAIN PAPER | COATED PAPER |
| BASIS WEIGHT | 55～61 | 90 | 100 |
| | 62～74 | 90 | 100 |
| | 75～80 | 90 | 100 |
| | 81～91 | 90 | 95 |
| | 92～105 | 85 | 90 |
| | 106～135 | 80 | 85 |
| | 136～176 | 0 | 80 |
| | 177～216 | 0 | 0 |
| | 217～256 | 0 | 0 |
| | 257～300 | 0 | 0 |
| | 301～350 | 0 | 0 |

FIG. 8

IMAGE FORMING APPARATUS

CROSS REFERENCE TO RELATED APPLICATIONS

This application is entitled to and claims the benefit of Japanese Patent Application No. 2012-210989, filed on Sep. 25, 2012, the disclosure of which including the specification, drawings and abstract is incorporated herein by reference in its entirety.

BACKGROUND OF THE INVENTION

1. Field of the Invention

The present invention relates to an image forming apparatus.

2. Description of Related Art

Generally, an electrophotographic image forming apparatus (such as a printer, copier, and facsimile machine) applies laser light based on image data to a charged photoconductor (light exposure) to form an electrostatic latent image. Then, the image forming apparatus directly or indirectly transfers a toner image, which is formed by causing toner to adhere to the electrostatic latent image, onto a sheet, and then heats and presses the toner image to fix the image to the sheet, thereby forming an image on the sheet.

A fixing device of the image forming apparatus that performs the above-mentioned fixing is occasionally provided with an air separator that applies air toward an end portion of a sheet having passed through a nip portion, in order to prevent a fixing defect caused by a sheet wound around a heating section for heating a toner image (for example a fixing belt). In particular, since a thin sheet with a small basis weight tends to easily wind around the heating section, it is required to direct high-speed air jets toward such a sheet. In order to deal with such a requirement, the air separator typically has a duct having a form in which its air outlet is substantially smaller than its air inlet.

There are known compressor type air separators that use a compressor as a source of air, and fan type air separators that use a fan motor as a source of air (for example, see Japanese Patent Application Laid-Open Nos. 10-265067 and 11-157678).

When the compressor type air separators and the fan type air separators are compared, the fan type air separators have advantages over the compressor type air separators in that the size can be reduced, manufacturing cost can be kept low, and the operation noise is small. However, since fan type air separators have significantly low static pressure as compared to compressor type air separators, a significantly large air quantity is required for obtaining an air velocity at which the sheet separation can be caused, and heat loss at a heating section is accordingly great. In addition, when the air quantity is large, a sheet having passed through a nip portion may flap, and as a result, wrinkles may be formed on the sheet and a sheet ejection path may be jammed with sheets, making ejection of sheets impossible. Therefore, it is important not only to ensure an air quantity required for obtaining an air velocity at which the sheet separation can be achieved, but also to suppress the air quantity to the degree that side effects such as the above-mentioned heat loss and flapping of sheets are not caused.

For example, Japanese Patent Application Laid-Open No. 2008-197654 discloses a technology for optimally adjusting the quantity of air from an air source. A fixing device disclosed in Japanese Patent Application Laid-Open No. 2008-197654 measures the amount of air pressure in an air passage by using a pressure sensor and optimizes the quantity of air by a feedback control based on a measured pressure value.

However, in existing fan type air separators, pressure loss of air passing through a duct is caused due to a substantially narrowed air outlet. When the feedback control of air based on the measured pressure value is performed in such a state, it is difficult to stabilize the air velocity since responsiveness to control is not good. As described, when the velocity of air jets directed toward sheets passing through a nip portion is unstable and varies, the position of sheets separated from the heating section may become unstable, and thus a jam may be caused in the sheet ejection path.

SUMMARY OF THE INVENTION

It is an object of the present invention to provide an image forming apparatus in which an application of air for separating a sheet from a fixing section can be performed in a stable manner with an appropriate air quantity and air velocity.

In order to achieve the object, an image forming apparatus reflecting one aspect of the present invention includes: a fixing section including a heating section that heats a sheet having an unfixed toner image, and a pressing section that forms a nip portion, the nip portion conveying the sheet in a sandwiching manner, the fixing section fixing the unfixed toner image to the sheet; an air separation section including a fan motor that generates an airflow, and a duct that defines a passage for a generated airflow, the air separation section applying air from the duct to the sheet ejected from the nip portion to separate the sheet from the heating section; and a control section that controls the fan motor by using a fan motor drive condition, the fan motor drive condition including a level or a duty cycle of a voltage to be applied to the fan motor, wherein the control section sets, on the basis of an individual difference of the fan motor, a fan motor drive condition for a sheet passing period in which the sheet passes through the nip portion, and the control section maintains the fan motor drive condition thus set throughout the sheet passing period.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 8 is a table for explaining a modification control operation of the fan motor drive condition on the basis of a stiffness of a sheet;

DESCRIPTION OF THE PREFERRED EMBODIMENTS

In the following, an embodiment of the present invention is described in detail with reference to the drawings.

Figure 1:
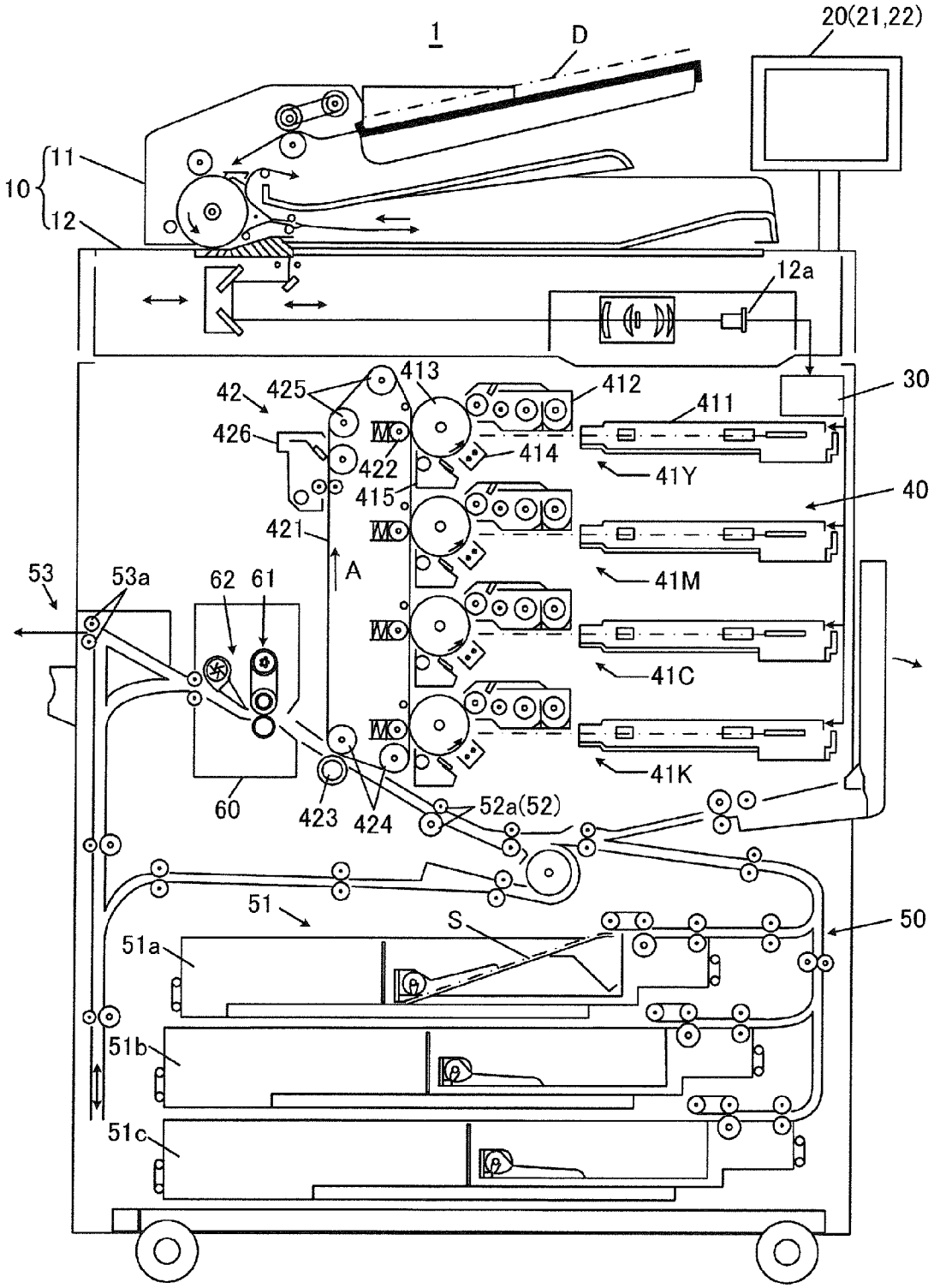
FIG. 1 illustrates a configuration of an image forming apparatus according to an embodiment of the present invention.
Figure 2:
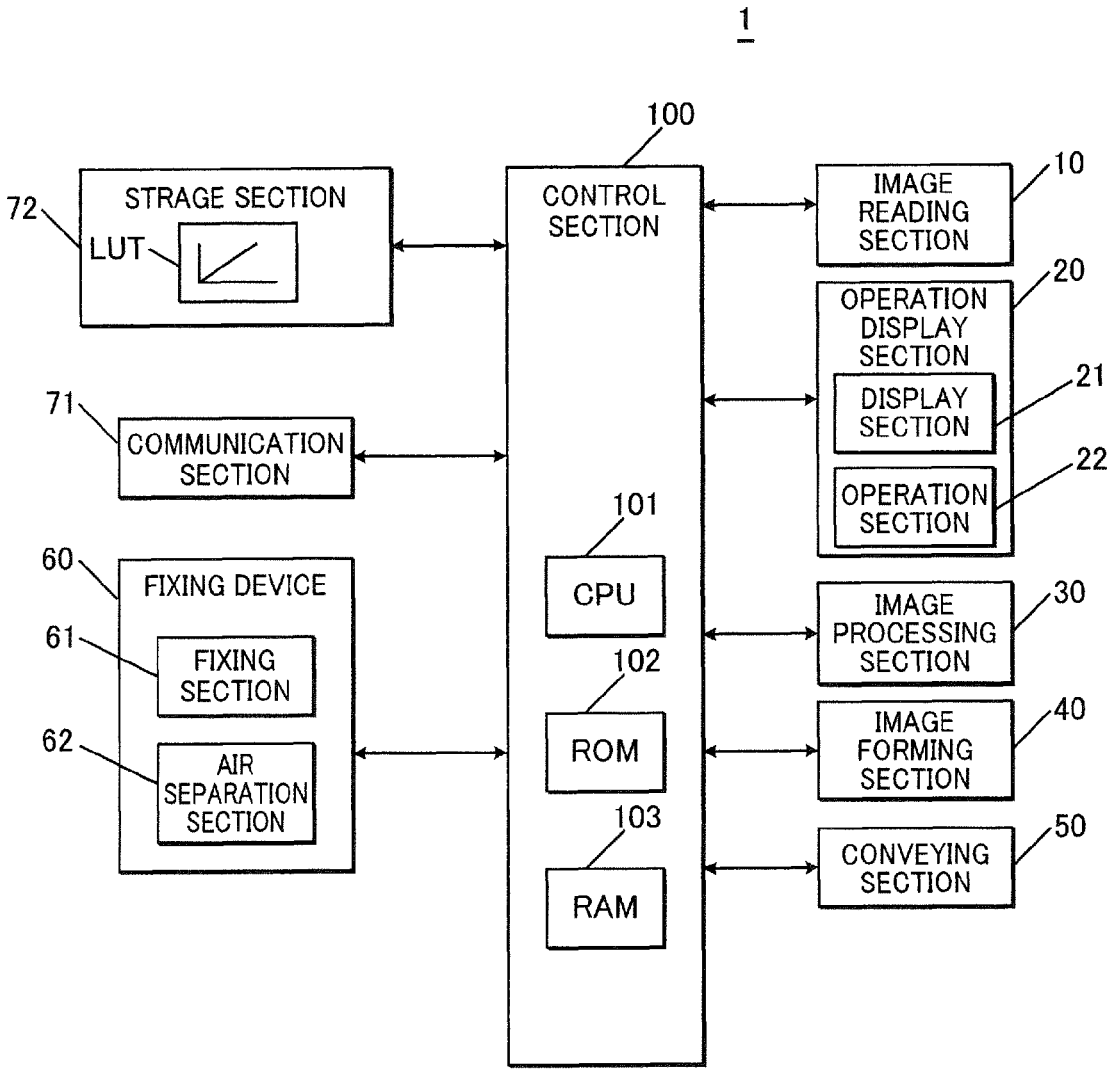
FIG. 2 illustrates a main section of a control system of the image forming apparatus according to the present embodiment.

FIG. 1 schematically illustrates a general configuration of an image forming apparatus according to an embodiment of the present invention, and FIG. 2 illustrates a main section of a control system of the image forming apparatus.

Image forming apparatus 1 illustrated in FIGS. 1 and 2 is an intermediate-transfer type color image forming apparatus utilizing the electrophotographic process. Specifically, image forming apparatus 1 transfers color toner images of C (cyan), M (magenta), Y (yellow), and K (black) formed on a photoconductor onto an intermediate transfer body (primary-transfer), superposes the toner images of the four colors on the intermediate transfer body, and then transfers the images onto a sheet (secondary transfer), thereby forming an image.

In addition, image forming apparatus 1 employs a tandem type in which photoconductors corresponding to the four colors of C, M, Y, and K are disposed in series along a travelling direction of an intermediate transfer member, and toner images of respective colors are sequentially transferred onto the intermediate transfer member in a single procedure.

As illustrated in FIGS. 1 and 2, image forming apparatus 1 includes image reading section 10, operation display section 20, image processing section 30, image forming section 40, conveying section 50, fixing device 60, and control section 100.

Control section 100 includes central processing unit (CPU) 101, read only memory (ROM) 102, random access memory (RAM) 103, and the like. CPU 101 reads out a program corresponding to processing details from ROM 102, loads the program in RAM 103, and performs a centralized control of operations of the blocks of image forming apparatus 1 in conjunction with the loaded program. At this time, various kinds of data such as a look up table (LUT) stored in storage section 72 are referenced. Storage section 72 is composed of a nonvolatile-semiconductor memory (so-called flash memory) or a hard disk drive, for example.

Control section 100 exchanges various kinds of data, via communication section 71, with an external apparatus (for example, a personal computer) connected through a communication network such as local area network (LAN) and wide area network (WAN). For example, control section 100 receives image data (input image data) sent from an external device, and forms an image on a recording sheet based on the received image data. Communication section 71 is composed of a communication control card such as a LAN card, for example.

Image reading section 10 includes an automatic document feeder 11 called auto document feeder (ADF), document image scanning device 12, and the like.

Automatic document feeder 11 conveys document D placed on a document tray by a conveying mechanism and outputs document D to document image scanning device 12. When multiple documents D are placed on the document tray, automatic document feeder 11 can successively read images (including images on both sides) of the documents D at one time.

Document image scanning device 12 optically scans document D conveyed onto a contact glass from automatic document feeder 11 or document D placed on the contact glass, brings light reflected from the document into an image on a light reception surface of charge coupled device (CCD) sensor 12*a*, and reads the image of the document. Image reading section 10 generates data of the input image based on results of the reading of document image scanning device 12. The data of the input image is subjected to a predetermined image process at image processing section 30.

Operation display section 20 is a liquid crystal display (LCD) provided with a touch panel for example, and functions as display section 21 and operation section 22. Display section 21 displays various kinds of operation screens, operating conditions of various functions, and the like according to a display control signal input from control section 100. Operation section 22 includes various kinds of operation keys such as numeric keys and a start key, receives various kinds of inputting operation by a user, and outputs an operation signal to control section 100.

Image processing section 30 includes a circuit that performs, on the input image data, a digital image process according to an initial setting or user setting, and the like. For example, under the control of control section 100, image processing section 30 performs a gray-scale correction based on gray-scale correction data (gray-scale correction table). In addition, image processing section 30 performs, on the input image data, various kinds of corrections such as, other than the gray-scale correction, a color correction and a shading correction, a compression process, and the like. Image forming section 40 is controlled based on the image data having been subjected to the aforementioned processes.

Image forming section 40 includes intermediate transfer unit 42, image forming units 41Y, 41M, 41C, and 41K that form images of colored toners of Y component, M component, C component, and K component on the basis of the input image data, and the like.

Image forming units 41Y, 41M, 41C, and 41K for Y component, M component, C component, and K component have configurations similar to each other. For convenience in illustration of the drawings and description, common components are denoted by the same reference numerals, and in the case where descriptions are separately given, Y, M, C or K is attached to the reference numeral. In FIG. 1, reference numerals are given only for elements of image forming unit 41Y for Y component, and reference numerals for elements of image forming units 41M, 41C, and 41K are omitted.

Image forming unit 41 includes exposing device 411, developing device 412, photoconductor drum 413, charging apparatus 414, drum cleaning apparatus 415, and the like.

Photoconductor drum 413 is a photoconductor having photoconductivity in which an undercoat layer (UCL), a charge generation layer (CGL), and charge transport layer (CTL) are sequentially laminated on a peripheral surface of a conductive cylindrical body made of aluminum (aluminum raw pipe), for example. Photoconductor drum 413 is a negative-charging type organic photoconductor (OPC) for example.

Charging apparatus 414 negatively charges the surface of photoconductive photoconductor drum 413 uniformly.

Exposing device 411 is composed of a semiconductor laser and applies laser light corresponding to images of respective color components to photoconductor drum 413, for example. When laser light is applied, and positive electric charge is generated in a charge generation layer of photoconductor drum 413 and transported to the surface of the charge transport layer, the electric charge on the surface of photoconductor drum 413 (negative charge) is neutralized. As a result, Electrostatic latent images for the respective color components are formed on the surface of photoconductor drum 413 due to a potential difference from the surrounding area.

Developing device 412 contains therein developers of the color components (for example, two-component developers each composed of a toner having a small particle size and a magnetic carrier), and causes toner of each color component to adhere onto the surface of photoconductor drum 413 so as to visualize an electrostatic latent image, thereby forming a toner image.

Drum cleaning device 415 includes a drum cleaning blade to be brought into sliding contact with the surface of photoconductor drum 413. Residual toner remaining on the surface of photoconductor drum 413 after the primary transfer is scraped and removed by the drum cleaning blade.

Intermediate transfer unit 42 (transfer apparatus) includes intermediate intermediate transfer belt 421 serving as a transfer body, primary transfer roller 422, secondary transfer roller 423, drive roller 424, driven roller 425, belt cleaning apparatus 426, and the like.

Intermediate transfer belt 421 is composed of an endless belt, and is installed in a stretched state around drive roller 424 and driven roller 425. Intermediate transfer belt 421 moves in an arrow A direction at a constant speed along with the rotation of drive roller 424. When intermediate transfer belt 421 is brought into pressure contact with photoconductor drum 413 by primary transfer roller 422, the toner images of respective colors are sequentially transferred onto intermediate transfer belt 421 in such a manner that the toner images overlap with each other (primary transfer). Then, when intermediate transfer belt 421 is brought into pressure contact with recording sheet S by secondary roller 423, the toner images primary-transferred on intermediate transfer belt 421 are transferred onto recording sheet S (secondary transfer).

Belt cleaning device 426 includes a belt cleaning blade to be brought into sliding contact with the surface of intermediate transfer belt 421. Residual toner remaining on the surface of intermediate transfer belt 421 after the secondary transfer is scraped and removed by the belt cleaning blade.

Fixing device 60 applies heat and pressure to recording sheet S having a toner image, which is an unfixed image at the time when it is transferred from intermediate transfer belt 421, at a fixing nip portion, thereby fixing the toner image on recording sheet S. Fixing device 60 is an air-separation type fixing device including fixing section 61 and air separating section 62. Specific configuration of fixing device 60 will be described later.

Conveying section 50 includes sheet feeding section 51, conveying mechanism 52, sheet ejecting section 53, and the like. Recording sheets (standard type sheets and special type sheets) S each discriminated based on the basis weight, size, and the like thereof are stored, according to predetermined types, in respective sheet tray units 51*a* to 51*c* configuring sheet feeding section 51.

The recording sheets S stored in sheet tray units 51*a* to 51*c* are output one by one from the uppermost, and conveyed to image forming section 40 by conveying mechanism 52 including a plurality of conveying rollers such as registration rollers 52*a*. At this time, a registration section in which registration rollers 52*a* are arranged corrects the obliqueness of the fed recording sheet S and adjusts the conveyance timing. Then, in image forming section 40, the toner image on intermediate transfer belt 421 is secondary-transferred onto a surface of recording sheet S, and a fixing step is performed in fixing section 60. Recording sheet S on which an image has been formed is ejected from image forming apparatus 1 by sheet ejecting section 53 including sheet ejecting roller 53*a*.

Figure 3:
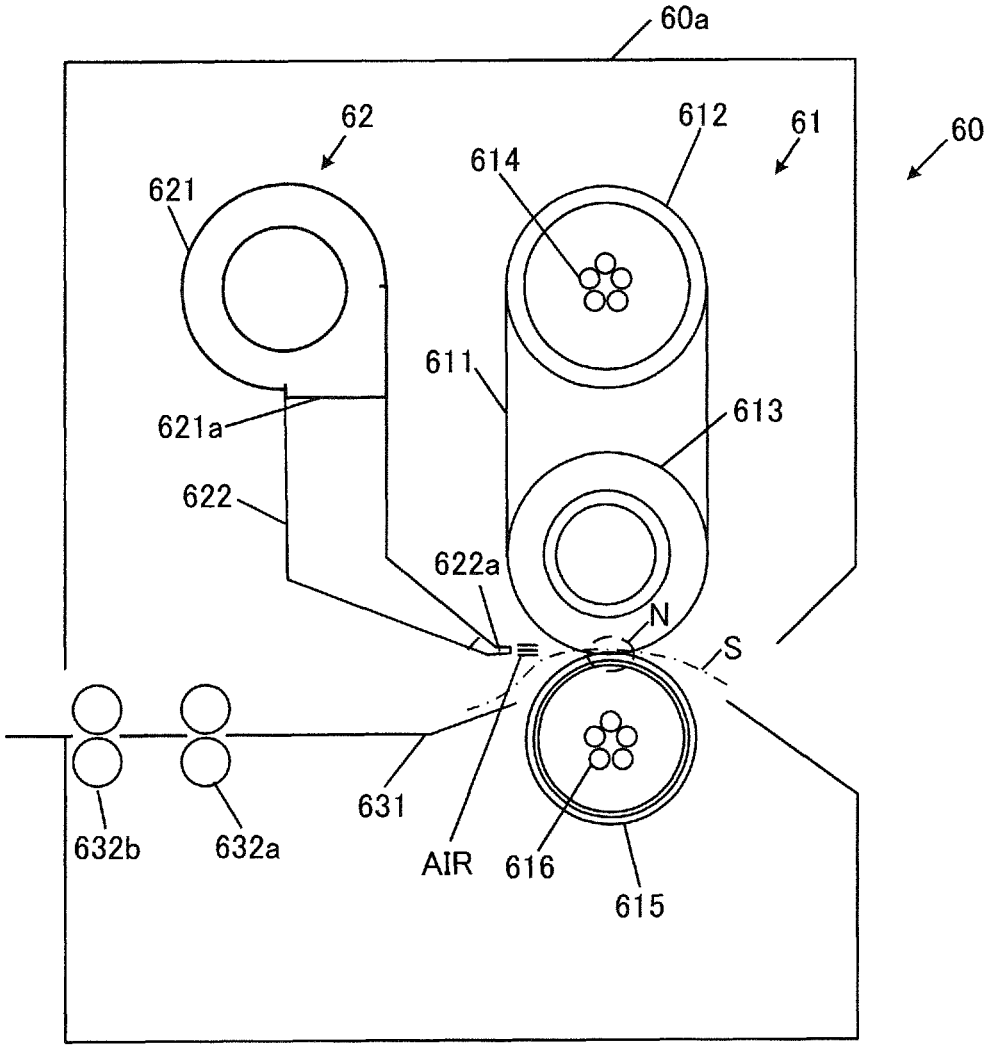
FIG. 3 illustrates a configuration of a fixing device in the image forming apparatus according to the present embodiment.

Now, the configuration of fixing device 60 is described in detail with reference to FIG. 3.

Fixing section 61 includes an upper pressing section in which endless fixing belt 611 is provided around heating roller 612 and fixing roller 613 at a predetermined belt tensile force (for example 200N), and a lower pressing section composed of pressure roller 615 (belt heating system). Pressure roller 615 and fixing roller 613 both have an elastically-deformable outer peripheral surface composed of a laminated structure described later. With such a structure, when pressure roller 615 is pressed by fixing roller 613 at a predetermined fixing load (for example, 2000 N) with fixing belt 611 therebetween, both of the outer peripheral surfaces of pressure roller 615 and fixing roller 613 are pushed down, whereby nip portion N having a certain nip width in a sheet conveyance direction is formed. In other words, the combination of the upper pressing section and the lower pressing section composes a pressing section in which nip portion N for conveying sheet S in a sandwiching manner is formed.

Fixing belt 611 has a structure in which an elastic layer made of silicone rubber or the like (thickness: 200 μm, and JIS-A hardness: 30°, for example) is stacked on the outer peripheral surface of a film base material made of polyimide having a heat resistance (thickness: 70 μm, for example), for example. In addition, a surface layer made of a fluorine resin such as a PFA (perfluoroalkoxyalkane) resin and a PTFE (polytetrafluoroethylene) resin may be stacked on the outer peripheral surface of the elastic layer.

Fixing belt 611 is a heating section that makes contact with sheet S on which a toner image has been formed to heat the sheet S at a fixing temperature (160 to 200° C., for example). The fixing temperature is a temperature at which a quantity of heat required for melting the toner on recording sheet S can be obtained. The fixing temperature differs depending on factors such as types of recording sheet S.

Heating roller 612 heats fixing belt 611 so that fixing belt 611 has the fixing temperature and thus the sheet S is heated by fixing belt 611 at the fixing temperature. Heating roller 612 has a structure in which a resin layer made of a PTFE resin or the like is formed on the outer peripheral surface of a cylindrical mandrel made of aluminum or the like, for example.

Heating roller 612 incorporates heat source 614 such as a halogen heater. The output of heat source 614 is controlled by control section 100. Heating roller 612 is heated by heat source 614, and as a result, fixing belt 611 is heated.

It is to be noted that the induction heating system may be employed to heat fixing belt 611 by induction heating (IH).

Fixing roller 613 has a structure in which an elastic layer made of silicone rubber or the like (thickness: 17 mm and JIS-A hardness: 10°, for example) and a surface layer made of a fluorine resin such as a PTFE resin are sequentially stacked on the outer peripheral surface of a cylindrical mandrel made of iron or the like (outer diameter: 50 mm, for example), for example. Fixing roller 613 is driven and controlled (for example, turn on/off of rotation, control of rotating speed, and the like) by control section 100.

Pressure roller 615 has a structure in which an elastic layer made of a silicone rubber or the like (thickness: 2 mm and JIS-A hardness: 30°, for example) and a surface layer composed of a PFA tube (thickness: 30 μm, for example) are sequentially stacked on the outer peripheral surface of a cylindrical mandrel made of iron or the like (outer diameter: 76 mm, for example), for example. Pressure roller 615 is supported such that it is movable between a position at which pressure roller 615 makes pressure contact with fixing roller 613 with fixing belt 611 therebetween and another position at which pressure roller 615 is separated from fixing roller 613 and fixing belt 611. Pressure roller 615 can be switched between the pressure contact state and the separated state. Pressure roller 615 is driven and controlled (for example, turn on/off of rotation, control of rotating speed, and the like) by control section 100.

Pressure roller 615 incorporates heat source 616 such as a halogen heater. The temperature of pressure roller 615 is maintained at a predetermined temperature (for example, 80 to 120° C.) by heat source 616 in order to stabilize the temperature of fixing belt 611 (or in order to suppress heat dissipation from fixing belt 611). The output of heat source 616 is controlled by control section 100.

Fixing section 61 is housed in housing 60*a* together with air separation section 62. When fixing section 61 is separated from the outside of fixing device 60 by housing 60*a*, the temperature of fixing belt 611 can be stably maintained.

Air separation section 62 includes fan motor 621 and duct 622. It is to be noted that, in the following description, fan motor 621 is referred to as "separation fan motor 621" for the purpose of discriminating fan motor 621 from a standard fan motor described later and a discharging fan motor (not illustrated) serving as an exhaust blower which is installed in image forming apparatus 1 and is configured to discharge air from image forming apparatus 1 to the outside.

Separation fan motor 621 is a sirocco fan (for example, maximum static pressure: 1200 Pa) for example. Under the control of control section 100, separation fan motor 621 generates an airflow. Specifically, control section 100 applies a voltage with an appropriately controlled voltage level or voltage duty cycle (fan motor drive condition) to separation fan motor 621 in order to drive separation fan motor 621, thereby generating the airflow.

An opening provided at an proximal end portion of duct 622 is in communication with air sending port 621*a* formed on a side surface of separation fan motor 621, whereby the airflow generated by separation fan motor 621 enters duct 622. In addition, air discharge port 622*a* provided at a distal end portion of duct 622 is disposed along a tangential direction of fixing roller 613 and is directed toward a predetermined air-jet target point. It is to be noted that the air-jet target point is a predetermined position which is located near a rear end portion of nip portion N in the sheet conveyance direction, on fixing roller 613 (for example, a position 15 mm from a rear end portion of nip portion N). In addition, duct 622 is movable between an air application position at which air discharge port 622*a* is directed toward the predetermined air-jet target point along the tangential direction of fixing roller 613, and an evacuation position at which duct 622 is evacuated from the air application position and air discharge port 622*a* is not directed toward the air-jet target point.

With the above-mentioned configuration, when separation fan motor 621 is driven, separation fan motor 621 generates an airflow, and the generated airflow enters duct 622. Then, air having flowed through duct 622 functioning as a passage of the airflow is discharged from air discharge port 622*a* toward the air-jet target point. Thus, during a sheet passing period in which sheet S passes through nip portion N, air jets are directed (applied), from duct 622, toward sheet S ejected from the nip portion, and as a result, sheet S is separated from fixing belt 611.

In order to achieve high-speed air jets for ensuring a sheet separating performance, duct 622 has a form in which the distal end portion is substantially narrowed relative to the proximal end portion. The area ratio of air discharge port 622*a* of the distal end portion to the opening of the proximal end portion is about 1/20, for example.

Incidentally, in order to ensure the sheet separating performance, it is preferable that air be applied uniformly in the axial direction of fixing roller 613. For this reason, in air separation section 62, a plurality of (3, for example) separation fan motors 621 and the same number of ducts 622 as separation fan motors 621 may be arranged side by side in the axial direction of fixing roller 613.

Sheet S separated from fixing belt 611 is conveyed along guide 631, and curl is corrected by curl correction roller (decurler) 632*a*, and thereafter, sheet S is ejected out of fixing device 60 by ejection roller 632*b*.

Hereinabove, the general configuration of image forming apparatus 1 and the configuration of fixing device 60 have been described. It is to be noted that, while the belt heating system is employed in fixing section 61 in the present embodiment, the roller heating system may alternatively be employed. In the case of the roller heating system, or in the case where the heating section is composed of fixing roller 613, fixing roller 613 incorporates a heat source such as a halogen heater, and fixing belt 611 and heating roller 612 are not provided. In addition, the configuration of image forming apparatus 1 is not specifically limited as long as image forming apparatus 1 includes fixing device 60 for performing the fixing step including heating and pressing at nip portion N, and control section 100 for controlling fixing device 60.

Next, a modification control of a fan motor drive condition will be described. It is to be noted that, here, an exemplary case where the fan motor drive condition to be modified is the voltage duty cycle will be described.

Since a modification control operation of the fan motor drive condition is typically performed in preparation for the applying of air to sheet S ejected from nip portion N, it is preferable to perform the modification control operation during a period different from the sheet passing period in which sheet S passes through nip portion N, i.e., during a period in which sheet S does not passes through nip portion N. For example, the modification control operation is carried out after the power of image forming apparatus 1 is turned on but before the first sheet passing period. When image forming apparatus 1 is intended for a production print for example, several tens of seconds to several minutes are normally required for a warm-up operation of fixing section 61 which is performed after the power is turned on. In contrast, the modification control operation described later can be completed at short times of several seconds to a dozen or so seconds. Thus, the first printing operation after the power of image forming apparatus 1 is turned on is not delayed. In addition, since the modification control operation can be carried out every time the power of image forming apparatus 1 is turned on, the control is simple. In addition, when the modification control operation is carried out every time the power of image forming apparatus 1 is turned on, the fan motor drive condition can be appropriately modified at all times even when separation fan motor 621 is degraded with age.

The following description explains a case where the modification control operation of the fan motor drive condition is performed based on the individual difference of separation fan motor 621.

In the case of generally-used fan motors, the individual difference caused at the time of manufacture, specifically, the variation in rotational frequency (rotational speed) per unit time in response to an applied voltage, is permitted to some degree. Therefore, there is the possibility that some fan motors offer an appropriate air velocity while others offer an inadequate or excessive air velocity when a voltage is applied at a certain voltage level or a certain voltage duty cycle. Furthermore, normally the individual difference of fan motors leading to variation in rotational speed varies along with the aging degradation of the fan motors, and the rotational speed gradually decreases.

In other words, there is a problem that the fan motor drive condition for obtaining an appropriate air velocity and air quantity depends on the individual difference of fan motors.

Figure 4:
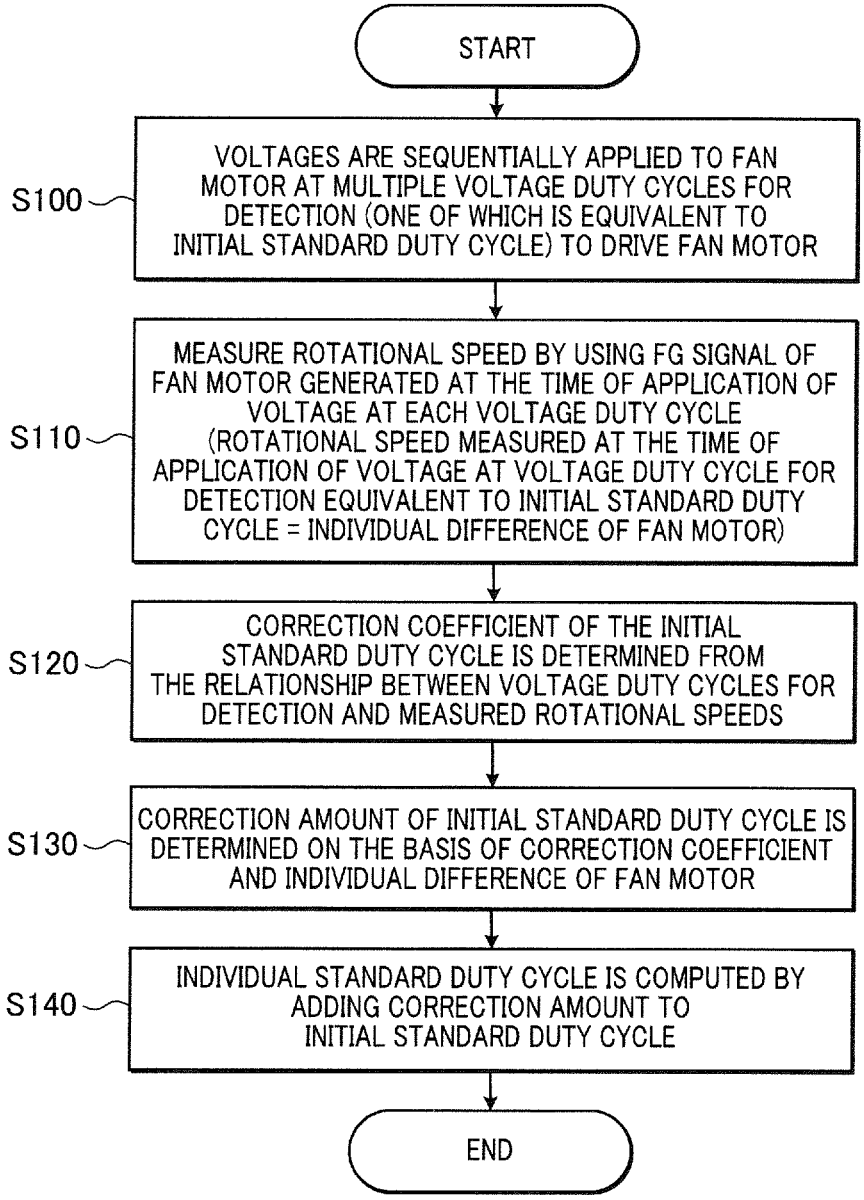
FIG. 4 is a flow chart for explaining a modification control operation of a fan motor drive condition on the basis of an individual difference of a separation fan motor.

FIG. 4 is a flow chart for explaining a modification control operation of the fan motor drive condition on the basis of the individual difference of separation fan motor 621, which can solve the above-mentioned problem.

First, at step S100, control section 100 sequentially applies voltages at multiple voltage duty cycles for detection to separation fan motor 621 in order to drive separation fan motor 621. It is to be noted that, for simplification of the modification control operation, one of the multiple voltage duty cycles for detection is set to a value equivalent to a predetermined initial standard duty cycle.

It is to be noted that, in the modification control operation in which the voltage duty cycle is variable, the level of the voltage to be applied to separation fan motor 621 is a constant value equal to or lower than the rated supply voltage. In addition, the variable setting of the voltage duty cycle can be achieved by a conventional pulse width modulation (PWM) control.

Figure 5:
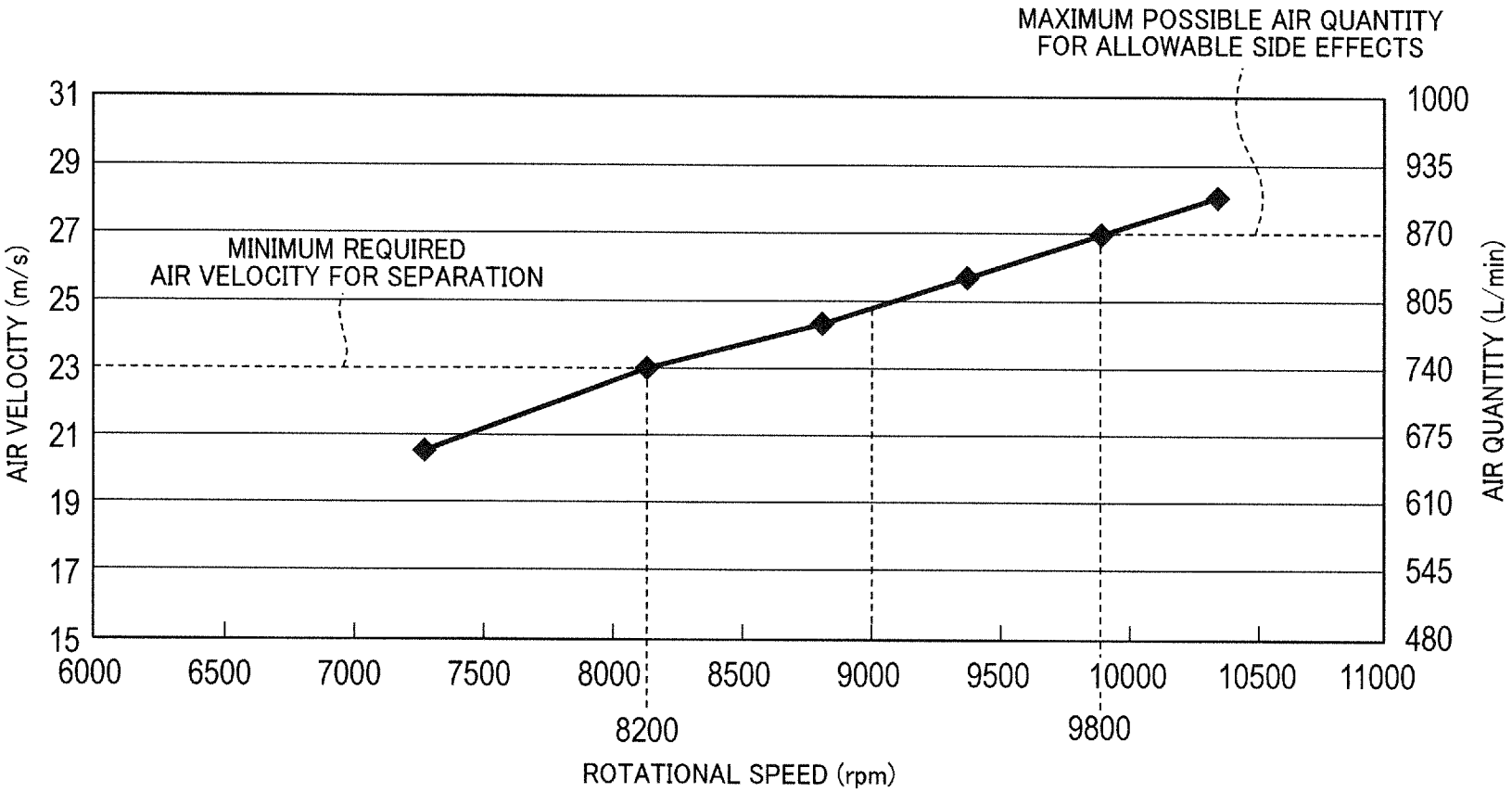
FIG. 5 shows relationships between a rotational speed of a standard fan motor and a velocity and a quantity of an airflow from the standard fan motor.

Here, upper and lower limits of the voltage duty cycle for detection are determined in advance by an experiment in which a standard fan motor having the same configuration as separation fan motor 621 is operated in an environment having the same configuration as that of fixing device 60. FIG. 5 shows exemplary relationships between the rotational speed of the standard fan motor and the velocity and quantity of the airflow generated by the standard fan motor, which are obtained through the experiment. In this example, when the standard fan motor rotates at a rotational speed of 8200 rpm, an air velocity of 23 m/s is obtained. The air velocity of 23 m/s is the minimum required value for the sheet separation, and therefore it is preferable that the rotational speed be 8200 rpm or greater. Therefore, the lower limit of the voltage duty cycle for detection is set to a value equivalent to a voltage duty cycle at which the standard fan motor rotates at 8200 rpm. In addition, in this example, when the rotational speed of the standard fan motor is greater than 9800 rpm, an excessive air quantity of 870 L/min or greater is obtained, and as a result, side effects such as the heat loss at the fixing belt become significant. Therefore, the rotational speed is preferably equal to or lower than 9800 rpm. Consequently, the upper limit of the voltage duty cycle for detection is set to a value equivalent to a voltage duty cycle at which the standard fan motor rotates at 9800 rpm. By limiting the range for the voltage duty cycle for detection as described above, the modification control operation of the fan motor drive condition can be carried out without the need for the application of air at a practically unsuitable air velocity or air quantity.

In addition, the initial standard duty cycle is corrected between the above-mentioned lower and upper limit values at a step described later. Accordingly, in order to ensure the upward correction width and the downward correction width in a balanced manner, the initial standard duty cycle is determined to a voltage duty cycle at which the standard fan motor rotates at a central value, 9000 rpm (standard rotational speed), of the lower limit value, 8200 rpm, and the upper limit value, 9800 rpm. In the present example, the initial standard duty cycle is 70%.

Then, at step S110, control section 100 measures the rotational speed of separation fan motor 621 by using a frequency generator (FG) signal of separation fan motor 621 generated at the time of applying voltage at each voltage duty cycle for detection. The FG signal is a signal generated by a FG circuit (not illustrated) installed in separation fan motor 621, and has a frequency proportional to the rotational speed of separation fan motor 621. Therefore, by converting a frequency of the FG signal detected from separation fan motor 621, the rotational speed of separation fan motor 621 can be readily measured.

Figure 6:
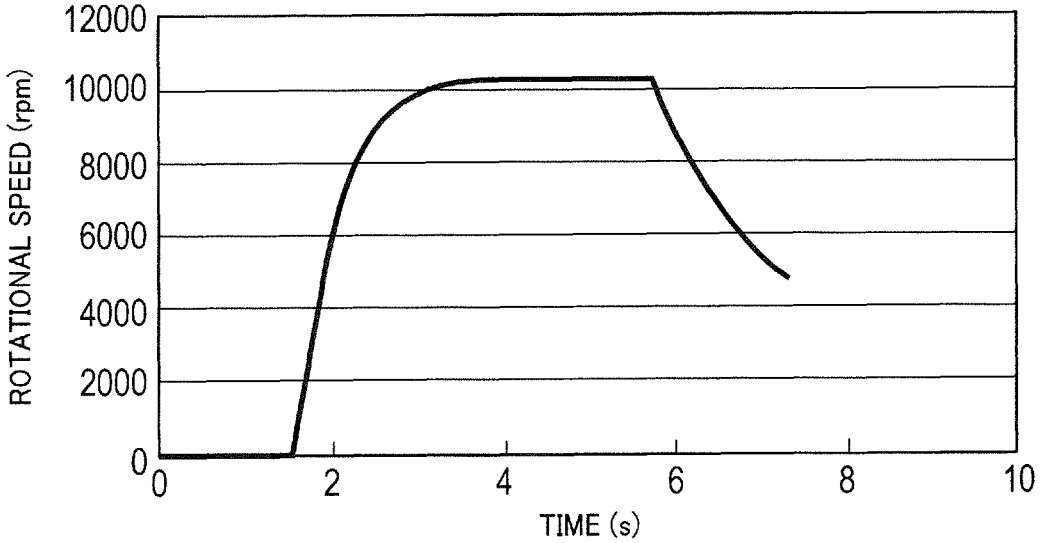
FIG. 6 illustrates an activation time of the separation fan motor.

Here, FIG. 6 illustrates the activation time of separation fan motor 621, which is confirmed through an experiment using the standard fan motor. It can be seen from FIG. 6 that the rotational speed of separation fan motor 621 is stabilized about two seconds after the start of voltage application, and the stabilized state is maintained until the voltage application is stopped. Therefore, the measured rotational speed acquired by control section 100 at step S110 is preferably a rotational speed of separation fan motor 621 at a point of time when two seconds elapses after the start of the voltage application at each voltage duty cycle for detection, or an average value of the rotational speed of separation fan motor 621 during several seconds (for example, three seconds) from the elapse of two seconds.

In addition, it is known that the rotational speed of separation fan motor 621 varies depending on the value of the ventilation resistance which is a cause of pressure loss. Therefore, it is desirable that the position of pressure roller 615 (i.e., the state of the pressing section), the position of duct 622, and the airflow around duct 622, each of which has influence on the value of the ventilation resistance, be the same between the case of the modification control operation and the case of the printing operation. Therefore, at the time of the modification control operation, control section 100 switches the state of the pressing section from the separated state to the pressure contact state, and moves duct 622 from the evacuation position to the air application position. It should be noted that the airflow around duct 622 may be destabilized by the operation of the discharging fan motor and thus the modification accuracy may be degraded, and therefore, during the modification control operation, control section 100 stops the discharging fan motor which is activated during the printing operation.

Figure 7:
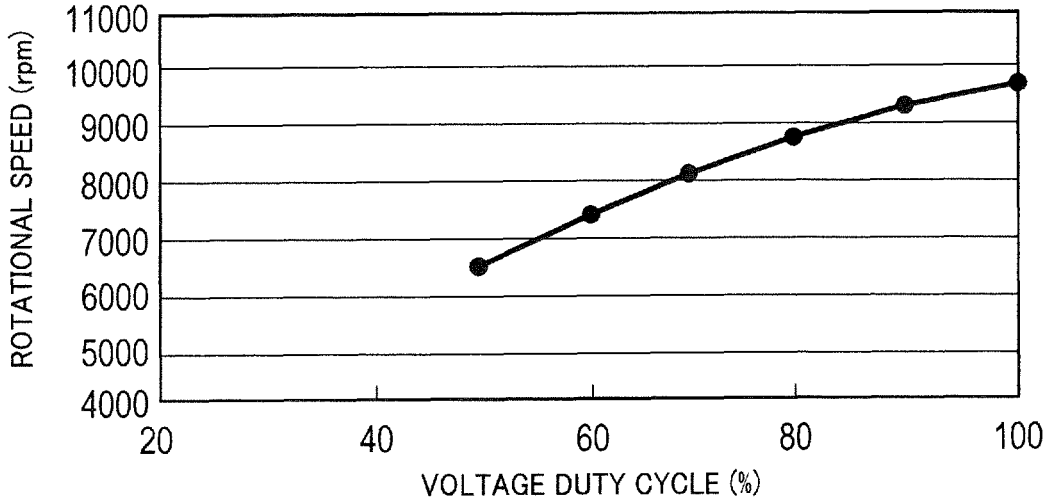
FIG. 7 illustrates relationships between a voltage duty cycle for detection and a rotational speed of the separation fan motor.

FIG. 7 illustrates the measured rotational speed of separation fan motor 621 relative to each voltage duty cycle for detection. In FIG. 7, for example, when the voltage duty cycle for detection is the same value as the initial standard duty cycle, i.e., 70%, the measured rotational speed of separation fan motor 621 is 8000 rpm, which is different from the standard rotational speed of 9000 rpm of the standard fan motor. That is, the individual difference of separation fan motor 621 is −1000 rpm, which is the difference of the measured rotational speed relative to the standard rotational speed. In this manner, control section 100 detects the individual difference of separation fan motor 621. Since the difference of the measured rotational speed relative to the standard rotational speed is used as an index representing the individual difference of separation fan motor 621, the detection of the individual difference of separation fan motor 621 is quantitative, and therefore, the correction of the initial standard duty cycle described later can be readily performed by numerical calculation.

At step S120, control section 100 computes a ratio of the variation in voltage duty cycle for detection to the variation in rotational speed of separation fan motor 621 on the basis of the measurement result at step S110, i.e., on the basis of the relationships between the voltage duty cycles for detection and the measured rotational speeds. Control section 100 determines the computed ratio as a correction coefficient of the initial standard duty cycle. For example, when the variation in rotational speed is +1 rpm and the variation in voltage duty cycle for detection is +0.014 percentage points, the correction coefficient of the initial standard duty cycle is 0.014.

Then, at step S130, control section 100 multiplies the detected value (−1000) representing the individual difference of separation fan motor 621, by the determined correction coefficient (0.014). The resulting product −14 means that the voltage duty cycle of the voltage applied to separation fan motor 621 is insufficient by 14 percentage points to rotate separation fan motor 621 at 9000 rpm which is equivalent to the standard rotational speed. Accordingly, control section 100 determines the shortage as the correction amount of the initial standard duty cycle.

Then, at step S140, control section 100 adds the correction amount to the initial standard duty cycle to compute the individual standard duty cycle inherent in separation fan motor 621. For example, when the correction amount is determined to be 14 percentage points as in the above-mentioned case, the individual standard duty cycle of separation fan motor 621 is 70+14=84[%].

As described above, according to the present embodiment, control section 100 can determine the individual standard duty cycle of separation fan motor 621 on the basis of the individual difference thereof. Also, control section 100 can use the individual standard duty cycle as a voltage duty cycle for the sheet passing period in which sheet S passes through nip portion N. In other words, it is possible to control separation fan motor 621 during the sheet passing period by using the voltage duty cycle appropriately set in accordance with the individual difference of separation fan motor 621. Thus, the application of air for separating sheet S from fixing belt 611 in fixing section 61 can be performed with an appropriate air quantity and air velocity. Further, according to the present embodiment, the feedback control which may undesirably destabilize the air velocity or air quantity are not performed, and control section 100 maintains the determined individual standard duty cycle throughout the sheet passing period as the voltage duty cycle used for controlling the separation fan motor 621. Therefore, the application of air with an appropriate air quantity and air velocity can be stabilized.

It is to be noted that, when the determined individual standard duty cycle is greater than 100[%], the control section 100 limit the voltage duty cycle used for controlling separation fan motor 621 during the sheet passing period, i.e., the voltage duty cycle for the sheet passing period, at 100[%] since the practicable maximum amount of the voltage duty cycle is 100[%]. It is to be noted that, when the fan motor drive condition to be modified is voltage level, an individual standard level which can be computed by a procedure similar to that of the individual standard duty cycle on the basis of an initial standard level of the voltage may be greater than the rated voltage of separation fan motor 621. In that case, control section 100 limits the individual standard level at a value equal to the rated voltage of separation fan motor 621. One reason for this is to prevent the breakage of separation fan motor 621.

When the above-mentioned limitations are imposed, separation fan motor 621 in use is no longer able to generate the required airflow. Therefore, it is preferable that control section 100 control display section 21 to display a massage about the possibility of a sheet ejection error or a message requesting replacement of separation fan motor 621, in order to urge a user to carry out an appropriate maintenance such as replacement of separation fan motor 621.

In addition, while multiple voltage duty cycles for detection are used in the modification control operation illustrated in FIG. 4, it is also possible to, simply, use only one voltage duty cycle for detection, i.e., only the initial standard duty cycle. In this modification, it is possible to previously acquire a relationship between the voltage duty cycle and the rotational speed by an experiment using the standard fan motor, and to use the relationship previously acquired in the standard fan motor together with the relationship between an initial standard duty cycle and a measured rotational speed newly acquired in the separation fan motor 621. This modification is advantageous over the example illustrated in FIG. 4 in that the measurement time can be shortened, whereas the example illustrated in FIG. 4 is advantageous over this modification in that an improved accuracy of the modification can be achieved.

Incidentally, in addition to the above-mentioned modification control operation of the fan motor drive condition on the basis of the individual difference of separation fan motor 621, control section 100 may perform a modification control operation of the fan motor drive condition on the basis of the stiffness of sheet S. This is because the air velocity required for the separation differs depending on the stiffness of sheet S, and for example, the lower the stiffness of the sheet, the higher intensity of the air application is required. The stiffness of sheet S differs mainly depending on the basis weight and type of sheet S. Under such a circumstance, control section 100 determines a utilization rate, which represents how much the individual standard duty cycle is utilized for the control of separation fan motor 621 during the sheet passing period, in accordance with the basis weight and type of sheet S discriminated in advance. As illustrated in FIG. 8, for example, when sheet S is a piece of coated paper having a basis weight of 55 to 61 [g/m$^2$], the utilization rate is 100[%], and when sheet S is a piece of plain paper having a basis weight of 92 to 105 [g/m$^2$], the utilization rate is 90[%]. Accordingly, when the individual standard duty cycle is assumed to be 84[%], in the former case where sheet S has a relatively low stiffness, the voltage duty cycle for the sheet passing period is set to 84×100=84[%]. On the other hand, while, in the latter case, the voltage duty cycle for the sheet passing period is set to 84×90=75.6[%], i.e., the voltage duty cycle is set to a value lower than that of coated paper, the stiffness of sheet S is relatively high, and therefore sheet S can be surely separated from fixing belt 611 by the application of air with a relatively low intensity. In addition, in the case where sheet S is a piece of plain paper, the application of air can be performed with a further reduced intensity since the stiffness of plain paper is higher than that of coated paper.

It is to be noted that, in FIG. 8, the utilization rate "0[%]" means that the individual standard duty cycle is not utilized at all. Utilization rate "0[%]" is applied only to sheet S with a very high stiffness. When utilization rate "0[%]" is applied, separation fan motor 621 is not driven and the application of air itself is not performed. However, by utilizing the fact that the stiffness of sheet S is very high, sheet S can be surely separated from fixing belt 611 without applying air.

Hereinabove, the embodiment of the present invention has been described.

The above-mentioned embodiment can be implemented with various modifications. For example, the timing at which the modification control operation is performed on the basis of the individual difference of separation fan motor 621 may not be the time at which the power of image forming apparatus 1 is turned on. Even when the above-mentioned modification control operation is carried out only when separation fan motor 621 is replaced or only when separation fan motor 621 is new, it is possible to deal with initial individual differences of separation fan motor 621 which are caused at the time of manufacture.

Figure 9A:
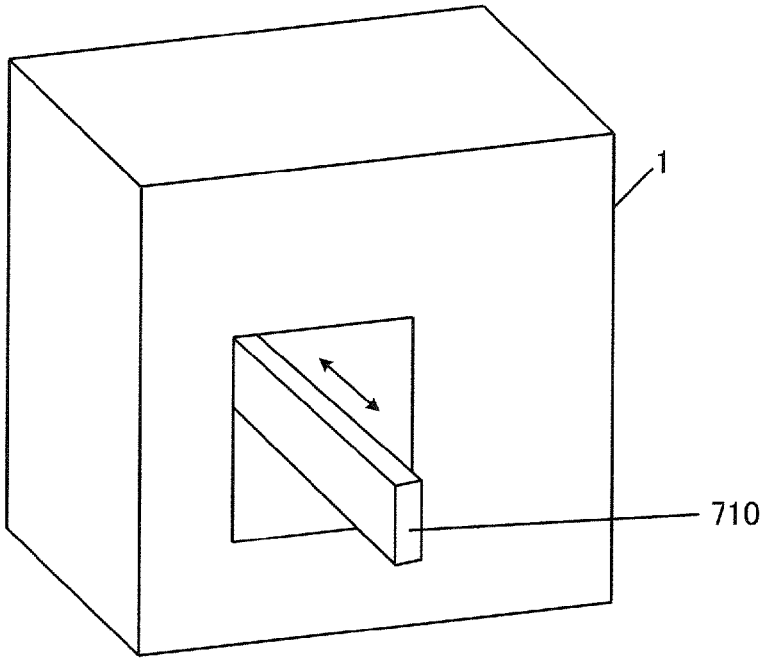
FIG. 9A illustrates an opening provided on a back surface of a main body of an image forming apparatus, and is a perspective view for explaining a mechanism for detecting a replacement of the separation fan motor.
Figure 9B:
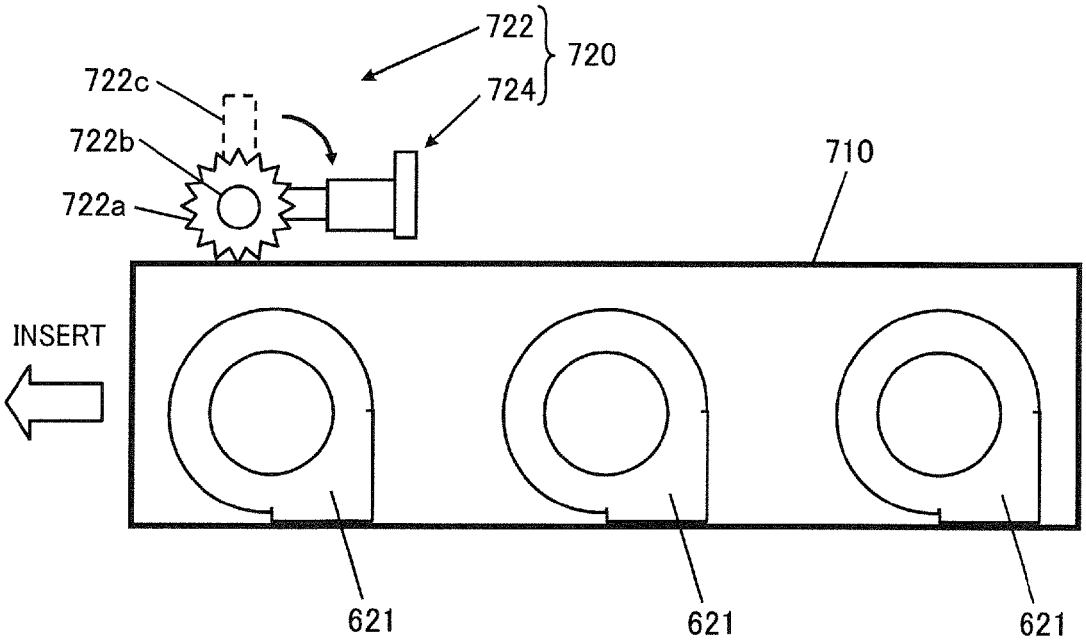
FIG. 9B illustrates a fan unit detection section disposed near the opening illustrated in FIG. 9A, and is a schematic view for explaining the mechanism for detecting the replacement of the separation fan motor.

Replacement of separation fan motor 621 can be detected by a mechanism exemplified in FIGS. 9A and 9B for example.

In this example, as illustrated in FIG. 9A, an opening is provided on a back surface of a main body of image forming apparatus 1. Additionally, although not illustrated, an opening is provided also on a back surface of housing 60*a* of fixing device 60. These openings are openings through which fan unit 710 can be inserted and extracted. In fan unit 710, three separation fan motors 621 are arranged side by side. In image forming apparatus 1, fan unit 710 can be inserted and extracted along the axis direction of fixing roller 613 through the openings. Fan unit detection section 720 illustrated in FIG. 9B is disposed near the opening of the back surface of the main body of image forming apparatus 1. Fan unit detection section 720 includes actuator 722 and photo coupler 724. Actuator 722 includes roller 722*a*, a shaft (roller shaft) 722*b* of roller 722*a*, and light shielding member 722*c*. Light shielding member 722*c* is coupled to roller axis 722*b* in such a manner as to extend perpendicularly to roller shaft 722*b*, and can be rotated along with roller 722*a*.

When fan unit 710 is inserted into image forming apparatus 1 through the opening, roller 722*a* is frictionally driven by a case of fan unit 710, whereby light shielding member 722*c* is rotated along with the roller 722*a*. This rotational movement is restricted by a stopper not illustrated, and is stopped at a position where a light path in photo coupler 724 is blocked. Thereafter, when the power of image forming apparatus 1 is turned on and thus a light emitting device in photo coupler 724 emits light, light shielding member 722*c* shields light. In this manner photo coupler 724 can detect the fact that light shielding member 722*c* has been rotated, i.e., the fact that fan unit 710 is inserted. By receiving a signal pertaining to the detection from photo coupler 724, control section 100 can detect the replacement of fan unit 710, i.e., the replacement of separation fan motor 621.

It is to be noted that, for the next detection of replacement, it is preferable to bring light shielding member 722*c* back to the initial position (in FIG. 9B, the position shown by a broken line) by rotating roller 722*a* backward by a motor not illustrated after every replacement, e.g., after every modification control operation. Alternatively, it is also possible that roller 722*a* is rotated backward by the friction against the case of fan unit 710 at the time when fan unit 710 is extracted.

Figure 10A:
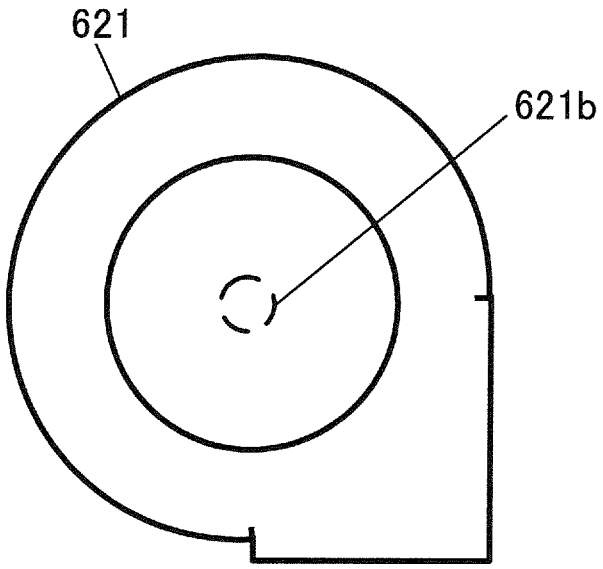
FIG. 10A illustrates a rotor shaft of the separation fan motor, and is a schematic view for explaining a mechanism for detecting whether the separation fan motor is new or not.
Figure 10B:
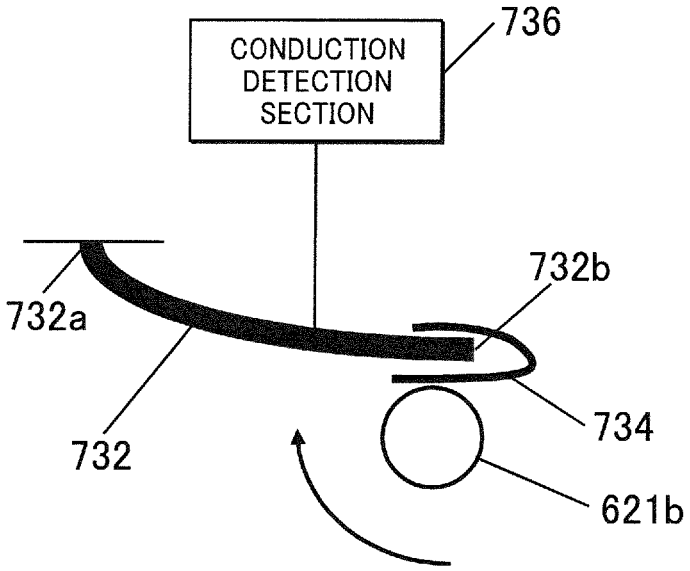
FIG. 10B illustrates an electrode that is pressed against the rotor shaft illustrated in FIG. 10A and is used in measurement of conduction between the rotor shaft and the electrode, and is a schematic view for explaining the mechanism for detecting whether the separation fan motor is new or not.

Whether separation fan motor 621 is new can be detected by a mechanism exemplified in FIGS. 10A and 10B, for example.

The mechanism in FIGS. 10A and 10B electrically detects whether separation fan motor 621 is in a used state or unused state, in other words, whether rotor shaft 621*b* of separation fan motor 621 illustrated in FIG. 10A has been rotated or not. More specifically, as illustrated in FIG. 10B, the mechanism employs electrode 732 having fixed terminal 732*a* fixed at a predetermined position, and free end 732*b* covered with insulating sheet 734. Free end 732*b* sandwiches insulating sheet 734 between rotor shaft 621*b* and free end 732*b*, and presses insulating sheet 734 against rotor shaft 621*b*. In addition, conduction detection section 736 detects the conduction between electrode 732 and rotor shaft 621*b*.

When separation fan motor 621 is in an unused state, electrode 732 and rotor shaft 621*b* do not make contact directly with each other since insulating sheet 734 exists therebetween and thus conduction detection section 736 detects a non-conductive state. By receiving a signal pertaining to the detection from conduction detection section 736, control section 100 can detect the fact that separation fan motor 621 is new.

Once separation fan motor 621 is rotated, insulating sheet 734 is dragged by rotor shaft 621*b*, and stripped and dropped from free end 732*b*, whereby electrode 732 makes direct contact with rotor shaft 621*b*. As a result, conduction detection section 736 detects a conduction state. By receiving a signal pertaining to the detection from conduction detection section 736, control section 100 can detect the fact that separation fan motor 621 has already been used, i.e., the fact that separation fan motor 621 is not new.

It should be understood by those skilled in the art that various modifications, combinations, sub-combinations and alterations may occur depending on design requirements and other factors in so far as they are within the scope of the appended claims or the equivalents thereof.

What is claimed is:

1. An image forming apparatus comprising:

a fixing section including a heating section that heats a sheet having an unfixed toner image, and a pressing section that forms a nip portion, the nip portion conveying the sheet in a sandwiching manner, the fixing section fixing the unfixed toner image to the sheet;

an air separation section including a fan motor that generates an airflow, and a duct that defines a passage for a generated airflow, the air separation section applying air from the duct to the sheet ejected from the nip portion to separate the sheet from the heating section; and a control section that controls the fan motor by using a fan motor drive condition, the fan motor drive condition including a level or a duty cycle of a voltage to be applied to the fan motor, wherein the control section sets, on the basis of an individual difference of the fan motor, the fan motor drive condition for a sheet passing period in which the sheet passes through the nip portion, and the control section maintains the fan motor drive condition thus set throughout the sheet passing period, the pressing section performs switching between a pressure contact state and a separated state, and the control section performs a control for switching a state of the pressing section from the separated state to the pressure contact state at a time of detecting the individual difference of the fan motor.

2. The image forming apparatus according to claim 1, wherein the control section detects a difference between a standard rotational speed and a measured rotational speed of the fan motor as an individual difference of the fan motor, the measured rotational speed being measured at a time when the voltage is applied to the fan motor in accordance with the fan motor drive condition for detection.

3. The image forming apparatus according to claim 2, wherein an upper limit and a lower limit of a voltage level or a voltage duty cycle for detection included in the fan motor drive condition for detection are determined in advance by an experiment using a standard fan motor.

4. The image forming apparatus according to claim 2, wherein the measured rotational speed is a rotational speed of the fan motor at a time point when a predetermined time elapses after a voltage is applied to the fan motor in accordance with the fan motor drive condition for detection, or an average value of the rotational speed of the fan motor after the elapse of the predetermined time.

5. The image forming apparatus according to claim 2, wherein the control section detects the individual difference of the fan motor during a period different from the sheet passing period.

6. The image forming apparatus according to claim 5, wherein the control section detects the individual difference of the fan motor after a power of the image forming apparatus is turned on but before a first sheet passing period.

7. The image forming apparatus according to claim 5, wherein the control section detects the individual difference of the fan motor when a replacement of the fan motor is detected.

8. The image forming apparatus according to claim 5, wherein the control section detects the individual difference of the fan motor when the fan motor is new.

9. The image forming apparatus according to claim 2, wherein the control section determines a correction coefficient of a standard fan motor drive condition corresponding to the standard rotational speed on the basis of a relationship between a plurality of fan motor drive conditions for detection and measured rotational speeds of the fan motor measured when voltages are applied to the fan motor in accordance with the fan motor drive conditions for detection, and determines a correction amount of the standard fan motor drive condition on the basis of a detected individual difference and a determined correction coefficient.

10. The image forming apparatus according to claim 1, wherein the duct is movable between an air application position and an evacuation position, and the control section performs a control for moving the duct from the evacuation position to the air application position at the time of detecting the individual difference of the fan motor.

11. The image forming apparatus according to claim 1 further comprising an exhaust blower that generates an airflow for discharging air to an outside, wherein the control section performs a control for stopping the exhaust blower at the time of detecting the individual difference of the fan motor.

12. The image forming apparatus according to claim 1, wherein the control section sets the fan motor drive condition for the sheet passing period on the basis of a stiffness of the sheet.

13. The image forming apparatus according to claim 1, wherein when a fan motor drive condition obtained by a correction on the basis of a detected individual difference is greater than a rated voltage of the fan motor or 100%, the control section limits the fan motor drive condition for the sheet passing period to a value equal to the rated voltage or 100%.

14. The image forming apparatus according to claim 13, wherein when the fan motor drive condition for the sheet passing period is limited to a value equal to the rated voltage or 100%, the control section performs a control for displaying on a display a message about a possibility of occurrence of a sheet ejection error or a message requesting a replacement of the fan motor.

* * * * *